US010252110B2

(12) United States Patent
Rhodes

(10) Patent No.: US 10,252,110 B2
(45) Date of Patent: Apr. 9, 2019

(54) HAND COVER APPARATUS

(71) Applicant: James Darren Rhodes, Agoura Hills, CA (US)

(72) Inventor: James Darren Rhodes, Agoura Hills, CA (US)

( * ) Notice: Subject to any disclaimer, the term of this patent is extended or adjusted under 35 U.S.C. 154(b) by 0 days.

(21) Appl. No.: 15/196,037

(22) Filed: Jun. 29, 2016

(65) Prior Publication Data

US 2018/0001147 A1 Jan. 4, 2018

(51) Int. Cl.

| | |
|---|---|
| ***A63B 31/12*** | (2006.01) |
| ***A63B 31/10*** | (2006.01) |
| ***A63B 31/04*** | (2006.01) |
| ***B63H 16/04*** | (2006.01) |
| *A41D 19/01* | (2006.01) |
| *A63B 69/00* | (2006.01) |
| *A63B 69/06* | (2006.01) |
| *A63B 71/14* | (2006.01) |
| *A63B 21/00* | (2006.01) |

(52) U.S. Cl.

CPC ..... *A63B 31/12* (2013.01); *A63B 31/04* (2013.01); *A63B 31/10* (2013.01); *B63H 16/04* (2013.01); *A41D 19/01* (2013.01); *A63B 21/4017* (2015.10); *A63B 21/4019* (2015.10); *A63B 21/4021* (2015.10); *A63B 69/0093* (2013.01); *A63B 69/06* (2013.01); *A63B 71/14* (2013.01); *A63B 2209/08* (2013.01); *A63B 2210/50* (2013.01); *A63B 2244/20* (2013.01)

(58) Field of Classification Search

CPC ..... A63B 31/00; A63B 31/02; A63B 31/08; A63B 31/10; A63B 31/11; A63B 31/12; A41D 19/01; A41D 19/0013

USPC ..... 441/56, 57, 58, 61

See application file for complete search history.

(56) References Cited

U.S. PATENT DOCUMENTS

| | | | | |
|---|---|---|---|---|
| 1,773,440 | A * | 8/1930 | Sbrolla | A63B 31/04 441/57 |
| 2,726,410 | A * | 12/1955 | Adamopoulos | A63B 31/04 441/57 |
| 2,771,618 | A | 11/1956 | Crum | |
| 3,097,375 | A | 7/1963 | Griffith | |
| 3,290,707 | A | 12/1966 | Montgomery | |
| 4,040,136 | A | 8/1977 | Garcia | |
| 4,746,313 | A | 5/1988 | Bray | |
| 4,756,699 | A | 7/1988 | Brom | |
| 5,376,036 | A | 12/1994 | Hull | |
| 5,511,998 | A | 4/1996 | Johnson | |
| 5,707,266 | A | 1/1998 | Arena | |
| 5,842,896 | A | 12/1998 | Liveoak | |
| 6,007,394 | A | 12/1999 | Kagan | |
| 6,364,727 | B1 | 4/2002 | Rangel | |
| 7,125,299 | B1 | 10/2006 | Ross | |
| 7,494,395 | B2 | 2/2009 | Krikliwy | |
| 8,585,453 | B2 | 11/2013 | Doyle | |
| 8,961,251 | B1 | 2/2015 | Lewis | |
| 2002/0077010 | A1 | 6/2002 | Lucas | |

(Continued)

*Primary Examiner* — Lars A Olson

(74) *Attorney, Agent, or Firm* — James Rhodes

(57) ABSTRACT

A hand cover apparatus with a tensioning mechanism that tensions a portion of the apparatus such that it is urged to retract to an open position, freeing a portion of the user's hand. Said system has one stationary piece and at least one additional piece that moves relative to it and can be triggered to free the hand by using only the hand to which it is mounted.

20 Claims, 16 Drawing Sheets

(56) References Cited

U.S. PATENT DOCUMENTS

| | | | |
|---|---|---|---|
| 2012/0009833 | A1 | 1/2012 | Doyle |
| 2013/0039776 | A1 | 2/2013 | Adams |

* cited by examiner

HAND COVER APPARATUS

CROSS REFERENCE TO RELATED APPLICATION

This application claims the benefit of Provisional Patent Application No. 62/185,713, filed Jun. 28, 2015, which application is hereby incorporated by reference along with all references cited therein.

BACKGROUND OF THE INVENTION

This invention relates to covers for the hand, and more particularly to covers for the hand which incorporate tension activated removal features.

Hand covers of all types have long been used for a great number of purposes. While often necessary for their purpose, they also have drawback associated with them. They often hinder or prohibit the use of the users hands and thus frequently need to be removed and reapplied so that I user can perform tasks with their unencumbered hands and fingers. It is often awkward, time-consuming, or inherently impractical for users to remove their hand covers and reapply them. Users are often faced with removing a hand cover or a portion of a hand cover from one hand while wearing a hand cover on the opposite hand, thus adding and even greater burden to the process. Hand covers of the prior art require both hands for the application and removal process.

The prior art has provided some answers to problems inherent to the use of hand covers. Some gloves, such as the HEAT3 brand, for example, have finger compartments that allow a user to fold them back on themselves and secure them to the rear portion of the glove where they snap into place or are secured in position by a hook and loop style fastener. These fold back gloves and mittens are referred to as "Pop Top" hand covers. While this style is effective it is still time consuming and requires both of a user's hands to operate. Others use a rope or cord to tether themselves to the user's forearm when not in use, but still must be pulled free of the user's hands. The gloves are then left to dangle near the user's hands, making them a further inconvenience, or even perhaps a danger.

U.S. Published Application No. 2013/0039776 shows a white water hand paddle that can break free from a user's hand and remain tethered around their wrist. This may seem useful in that the paddle might not be lost, but whitewater conditions make a hard piece of plastic loosely tethered around the wrist not only inconvenient but dangerous to life and limb.

There also have been many different types of forearm-mounted swimmer's aids that have been used in the past, such as U.S. Pat. No. 2,771,618 that discloses pivoting fins on a forearm sleeve. These types of devices may potentially be used in surfboarding, in that the hand is freed up for handling the surfboard, but rarely are because they have numerous drawbacks and limitations. Simply put, the weight they add to the arm is less than offset by the increase in padding power and efficiency gained. This would perhaps actually increase fatigue associated with moving though the water.

Most surfers do not use paddles or in any way cover their hands. They know that they are going to need to use their free hands to grab and maneuver their boards not merely once but continuously throughout their surfing process. Almost all other water sports benefit from the use of paddles for maximum speed, power, and efficiency. Surfers don't typically use paddles because they constantly require the use of their hands to adjust and position their surfboards and paddles can impede that process. To be of maximum benefit a paddle needs to be positioned in front of the hand exactly where it most impedes the use of a hand.

A surfer must have free hands to grab his board and force it down under an oncoming wave in a maneuver called a "duck dive". The speed at which a surfer is moving through the water toward a wave and the safety of deeper water is critical to their successful effort to dive under it as opposed to getting washed over the top of it and thrown back toward the shore. Furthermore, a surfer who is able to paddle through the water quickly is more likely to beat large sets of incoming waves entirely by getting out into deep water beyond the depth where they are breaking with greater speed.

A surfer must match the speed that an incoming wave is moving to catch it and thus they paddle excessively as the wave approaches to gain the position and speed required to catch the wave but only have their bare hands or webbed finger gloves to do so. The larger a wave is the faster a surfer must be moving to catch it. Thus a surfer must accurately read the characteristics of an incoming wave, decide whether to pursue it, position themselves and propel themselves through the water at a sufficient speed to catch it. The larger a wave is the larger the amount of time and space is required to do this.

At some point, waves become uncatchable without some sort of aid. Hand paddles can reduce the amount of time and space required for a surfer to respond to a large incoming wave and also increase their acceleration times and peak paddle speeds. This would allow paddle in surfers to catch waves larger than ever before possible.

The added surface area that hand paddles create not only increases acceleration power, but also stopping power, allowing a surfer to brake in the water and back themselves out of dangerous incoming waves that they previously would have had no choice but to allow their forward momentum to carry them straight into. These types of safety concerns are also important. When dealing with large crashing waves and white water conditions, a rigid paddle strapped to your hand or arm could become a dangerous weapon capable of causing severe damage to a surfer and/or others if caught and tossed about by the force of the surrounding water. For safety reasons, a paddle's design should include padding, be as compact as possible when not in use, be able to open and close easily, and remain closed under the turbulence and force of hostile and unpredictable water forces and conditions.

As another concern associated with surfing, the constant repetitive motion of the swimming stroke makes serious joint problems more likely. By transferring more of the work of paddling from the joints to the muscles, reduction of injuries can be achieved.

The prior art to date has not provided a safe, timely, and functional answer to the many problems posed by the application, removal, and stowing hand covers as addressed above.

SUMMARY OF THE INVENTION

One aspect of the invention involves an arm-mounted hand paddle with a sleeve configured for securement about the forearm of a user. The sleeve has a pivot post to which a multi-levered scissor assembly is attached thereto at its fulcrum. A tensioning member connected to at least two of the levers tension them toward one another. A ribbed paddle blade is connected to the scissor assembly. A harness connected to the blade is configured to engage at least one finger of the user.

Another aspect of the invention involves an arm-mounted hand paddle with a sleeve configured for securement about the forearm of a user. A guide track on said sleeve, oriented to align with the length of the forearm, has a track follower therein. A tensioning member connected to the track and track follower tensions the follower toward the proximal of the track. A multi-levered scissor assembly has its fulcrum attached to the track follower. A rein is attached to the track follower and is positioned to traverse the user's hand. A harness configured to engage at least one finger of the user is connected to the rein. A collapsible paddle blade is connected to the harness and the scissor assembly.

A further aspect of the invention involves an arm-mounted hand paddle having a sleeve configured for securement about the forearm of a user. A collapsible paddle blade connected to the sleeved is tensioned to collapse the blade into a closed position. A harness connected to the blade is configured to engage at least one finger of the user so that extension of the finger urges the blade toward an opened position.

The objects and advantages of the present invention will be more apparent upon reading the following detailed description in conjunction with the accompanying drawings.

BRIEF DESCRIPTION OF THE DRAWINGS

FIG. 20*a* is a bottom plan view of a paddle blade according to the present invention.

DETAILED DESCRIPTION OF PREFERRED EMBODIMENTS

Figure 1:
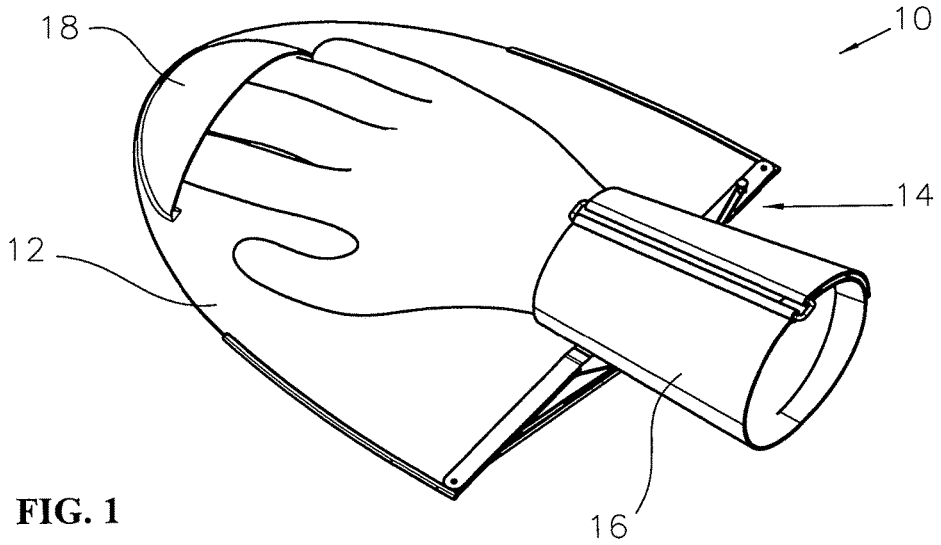
FIG. 1 is a perspective view of a person's hand inserted into a first preferred embodiment of a hand cover apparatus, in the form of a hand paddle, according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further application of the principles of the invention illustrated therein being contemplated as would normally occur to one skilled in the art to which the invention relates.

Figure 2:
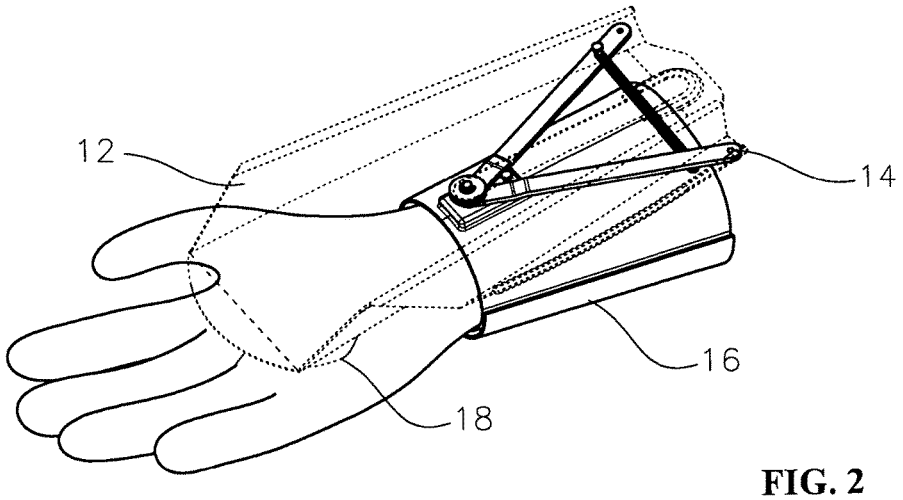
FIG. 2 is a perspective view of the hand paddle of FIG. 1 with its blade collapsed, shown in hidden line form to reveal aspects of the embodiment.
Figure 3:
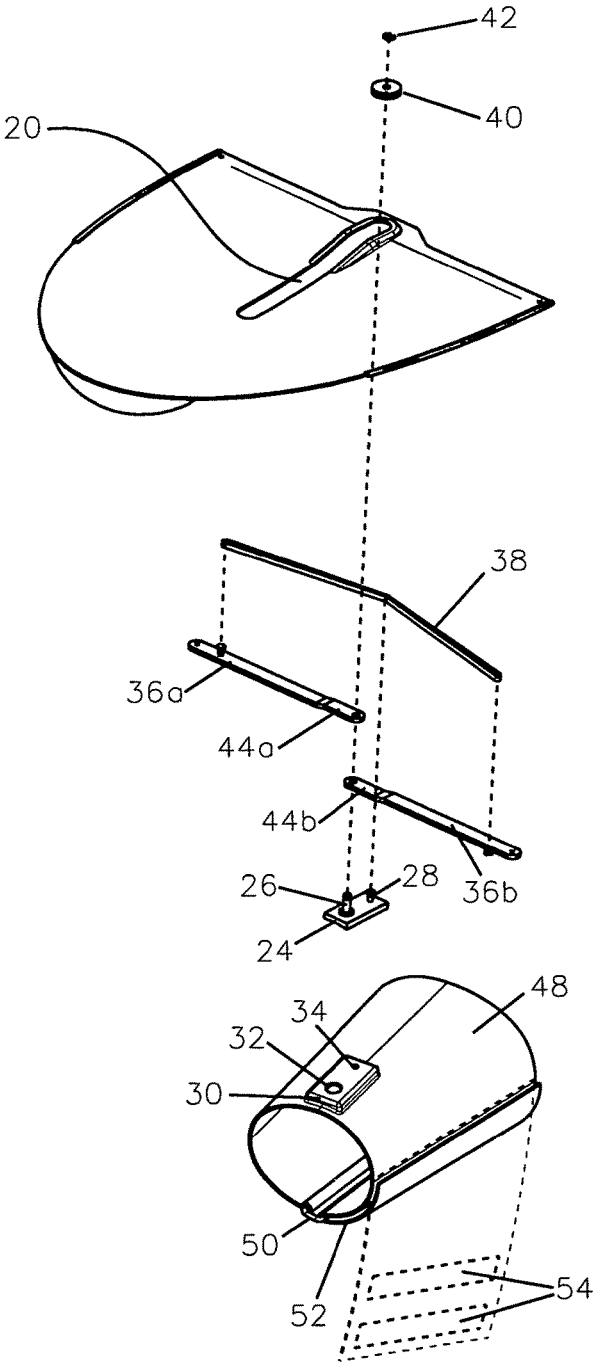
FIG. 3 is an exploded view of the hand paddle of FIG. 1.

FIGS. 1-5 show a first preferred embodiment of a hand paddle 10 according to the present invention with a person's hand inserted in it FIGS. 1 and 2. The hand paddle generally comprises a paddle blade 12; a tensioning mechanism 14; and a sleeve 16.

Figure 4:
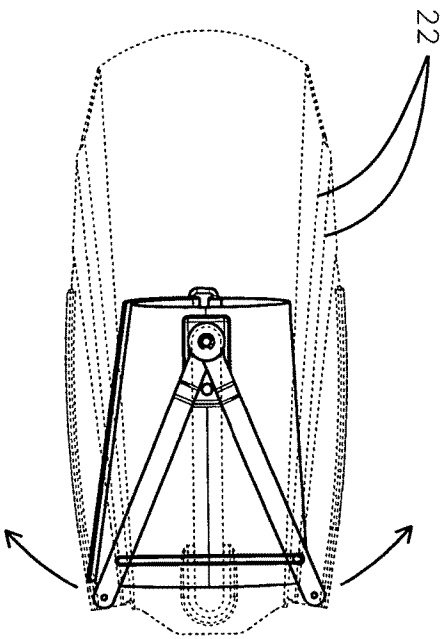
FIG. 4 is a top plan view of the hand paddle of FIG. 1 with its blade in its closed position.
Figure 5:
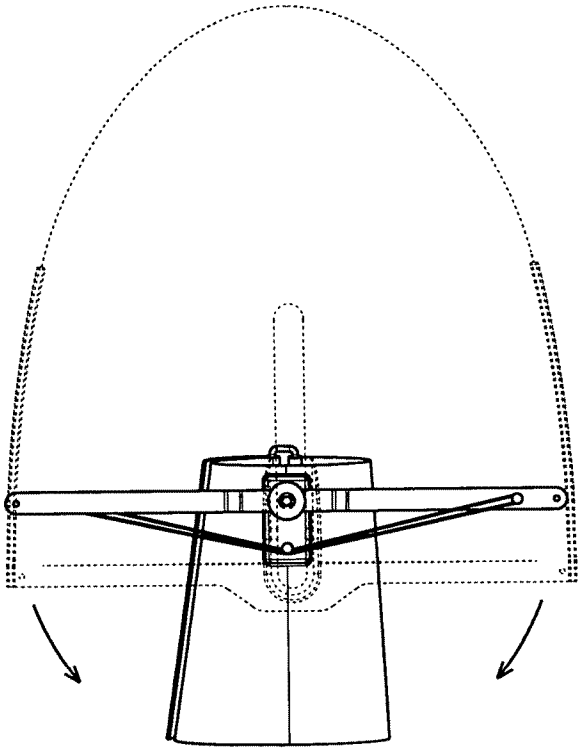
FIG. 5 is a top plan view of the hand paddle of FIG. 1 with its blade in its open position.

Major features of the paddle blade 12 include finger pocket 18, used as a harness to operate the hand paddle 10; an oblong slot 20 (FIG. 3) that interacts with the tensioning mechanism 14; and a number of folding points or ribs 22 (FIG. 4, shown in hidden lines). Paddle blade 12 may be made of suitable materials such as neoprene, nylon, carbon fiber, nylon fiber, or fiberglass, for example. Paddle 12 may also be made of softer materials, such as nylon or latex-type fabrics, or stronger materials such as aluminum or polycarbonate plastic. Finger pocket 18 may be made of the same material as blade 12, or may be made of some other suitable material. It is generally designed to remain slightly elevated over blade 12 so that fingers may be easily inserted therein.

Major features of tensioning mechanism 14 include (FIG. 3) tensioner plate 24 with pivot post 26 and tensioner post 28; tensioner cover 30 with post apertures 32, 34 therethrough; multi-levered scissor assembly with tensioner levers 36*a* and 36*b*; tensioning member 38; and retaining washer 40 and retaining clip 42. Ends 44*a* and 44*b* of levers

36*a*, 36*b* are pivotally connected to the pivot post 26, creating center fulcrum 46 (FIG. 4). One end of tensioning member 38 is connected to lever 36*a* and the other end is connected to lever 36*b*, such that the elasticity of tensioning member 38 tensions lever ends 44*a* and 44*b* toward one another and urges the scissor assembly into a closed position, as best perhaps can be appreciated when viewing FIGS. 4 and 5 together. Tensioner post 28 maintains pressure on tensioning member 38 when blade 12 is fully opened.

Tensioning mechanism 14 parts may be made of various suitable materials such as stainless steel, polycarbonate, acrylic and/or ABS plastics, to name a few. Tensioning member 38 may take the form of an elastic band or bungee-type cord (shock cord) and may be made out of elastic material, such as butyl rubber, for example. The tensioning bands may be made to be changeable, allowing a selection of tensioning options, and for ease of replacement when worn.

Major features of the sleeve 16 include band 48; cinching ring 50; band flap 52 and fastener 54. Band 48 is typically made of foamed neoprene, although other suitably similar materials may be used. Cinching ring 50 may be made of stainless steel or common plastic substitutes therefore, such as polycarbonate, for example. Fastener 54 is shown in the form of a hook and loop fastener closure, popularly known in connection with the Velcro trademark, although other types of fasteners may be used, such as snaps or buttons, for example.

The sleeve and the entire paddle should be made as light and durable as possible. A non slip coating (not shown) may be added to one or both sides of sleeve 16 to help secure it in position. Optionally, sleeve 16 could clip to, or secure itself under, a wetsuit sleeve to reduce or even eliminate the need for a separate band and fastening system to minimize weight.

When used, a person places a hand through sleeve 16 such that the cuff of sleeve 16 is positioned adjacent the wrist area (FIGS. 1 and 2), and cinches it to the arm so that sleeve 16 does not rotate on the arm during use of hand paddle 10. One or more fingers may be placed in finger pocket 18 and extended, such that the collapsible paddle blade 12 is moved from a closed position (FIG. 2) to an open position (FIG. 1). From an open position (FIG. 1), the fingers tips are simply bent down and in to allow the finger pocket to slip free of them. The tensioning mechanism 14 will then snap the paddle back on the forearm into its compact, closed position (FIG. 2). This allows the user free, unhindered use of the hands.

Figure 6:
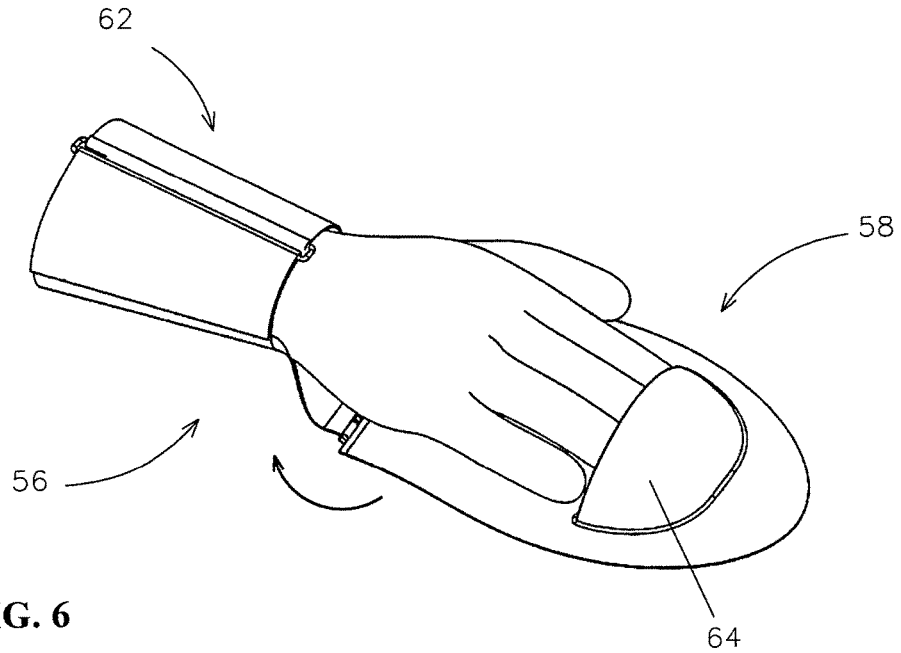
FIG. 6 is a perspective view of a person's hand inserted into a second preferred embodiment of a hand cover apparatus, in the form of a hand paddle, according to the present invention.
Figure 7:
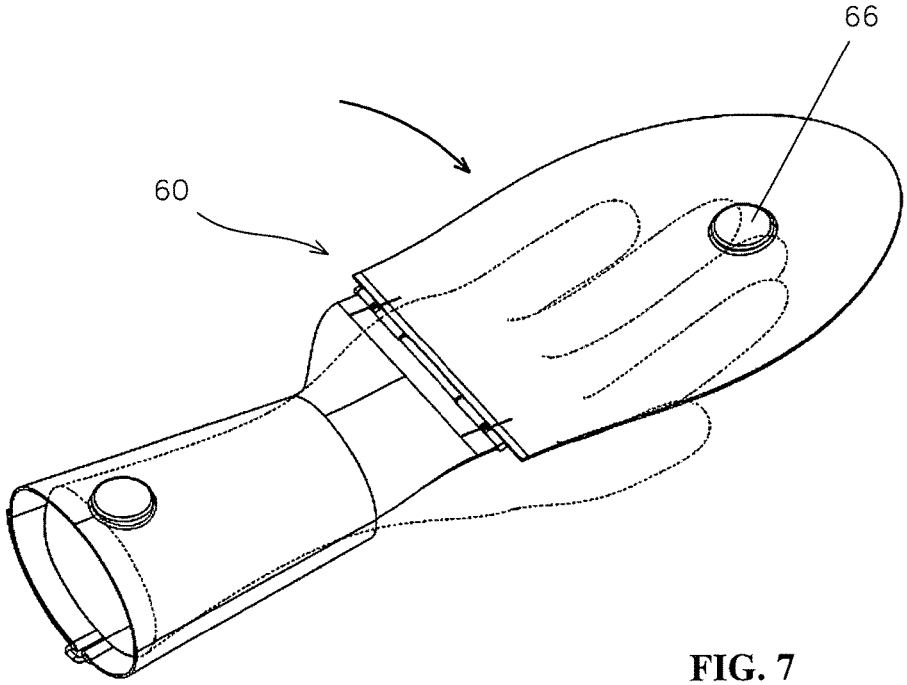
FIG. 7 is another perspective view of the hand paddle of FIG. 6.
Figure 8:
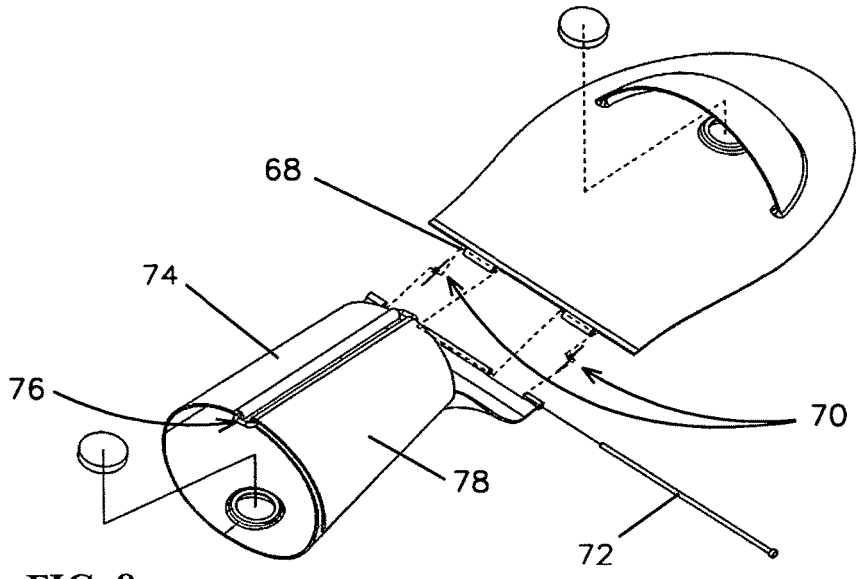
FIG. 8 is an exploded perspective view of the hand paddle of FIG. 6.
Figure 9:
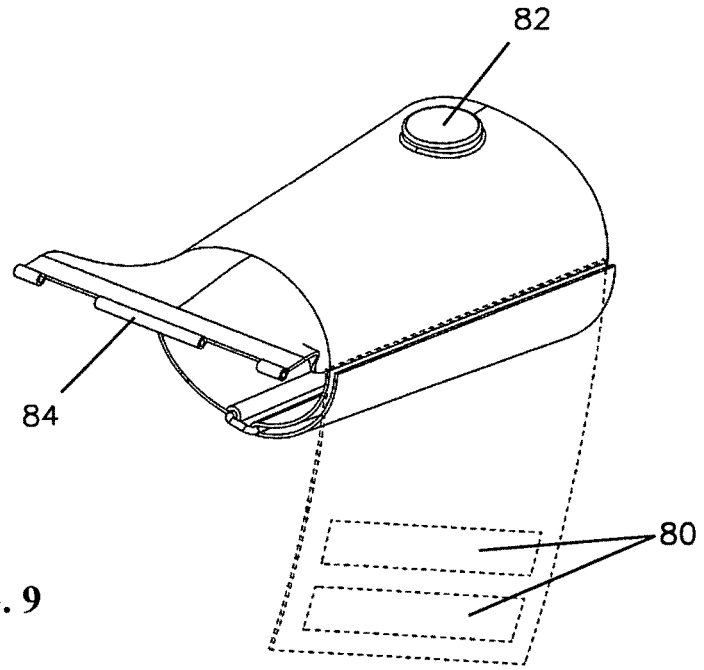
FIG. 9 is a perspective view of the sleeve of the hand paddle of FIG. 6.

FIGS. 6-9 show a second preferred embodiment of a hand paddle 56 according to the present invention with a person's hand inserted in it in FIGS. 6 and 7. The hand paddle generally comprises paddle blade 58, tensioning mechanism 60; and a sleeve 62. The materials and alternative structures mentioned in the description of the first preferred embodiment equally apply here where the same or similar parts or features are used or employed.

Major features of paddle blade 58 include finger pocket 64, used as a harness to operate the hand paddle; a retaining member 66, shown as a magnetized surface; and hinge leaf 68, shown as part of a barrel-type hinge.

Major features of tensioning mechanism 60 include tensioning members 70, shown in the form of torsion springs (best shown in FIG. 8); and hinge pin 72.

Major features of sleeve 62 include band 74; cinching ring 76; band flap 78 with closure 80; retaining member 82, shown as a magnetized surface that attracts magnetized surface 66 of blade 58; and co-operating hinge leaf 84.

When used, a person places a hand through sleeve 62 such that the cuff of sleeve 62 is positioned adjacent the wrist area (FIGS. 6 and 7), and cinches it to the arm so that sleeve 62 does not rotate on the arm during use of hand paddle 56. One or more fingers may be placed in finger pocket 64 and extended, such that the collapsible paddle blade 58 is moved from a closed position (not shown) to an open position (FIG. 7). The finger pocket 64 may be located at different places on blade 58 to accommodate different sized hands. Similarly, the fold of the paddle will be located so the finger pocket 64 is easy for a user to reach to open the paddle.

Figure 10:
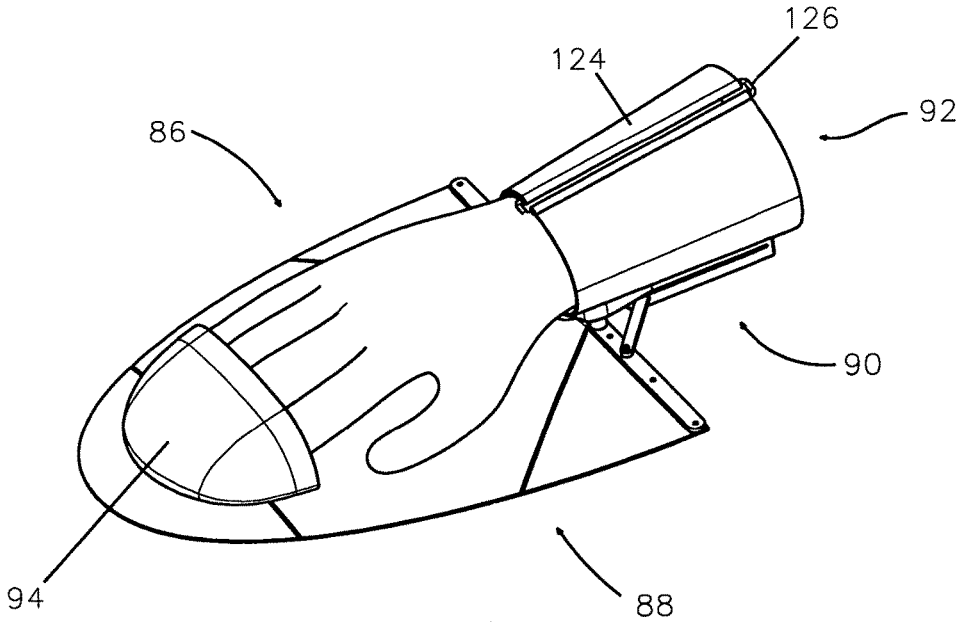
FIG. 10 is a perspective view of a person's hand inserted into a third preferred embodiment of a hand cover apparatus, in the form of a hand paddle, according to the present invention.
Figure 11:
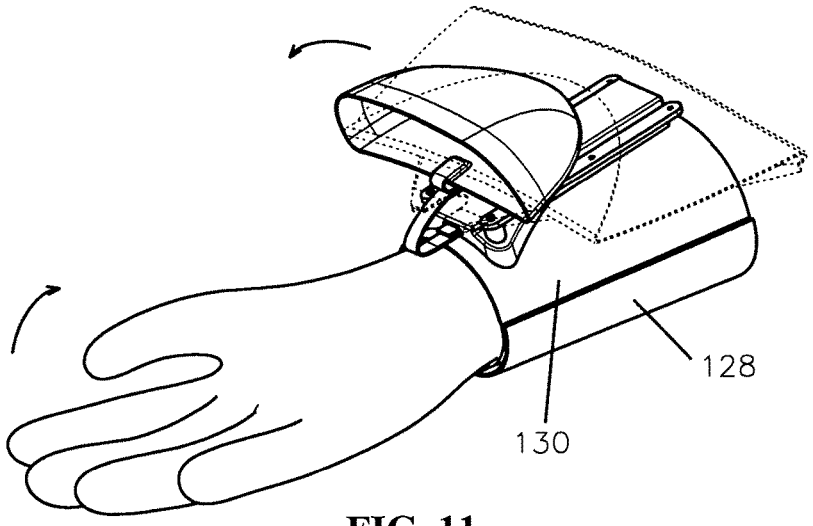
FIG. 11 is a perspective view of the hand paddle of FIG. 10 with its blade in its closed position.
Figure 12:
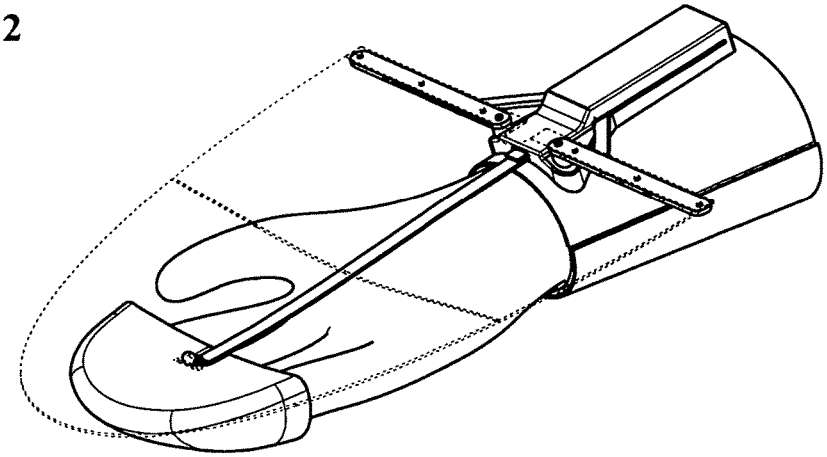
FIG. 12 is a perspective view of the hand paddle of FIG. 10 with its blade shown in hidden line form to reveal aspects of the embodiment.
Figure 13:
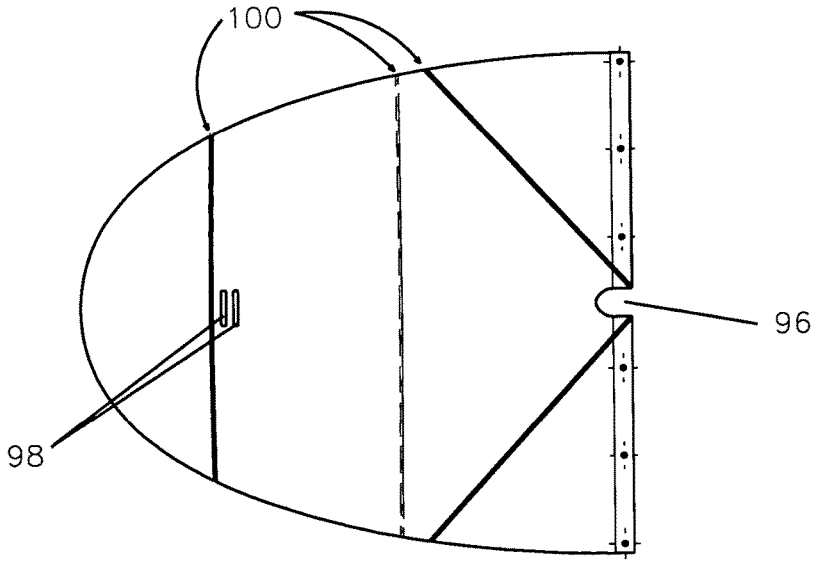
FIG. 13 is a plan view of the blade of the hand paddle of FIG. 10.
Figure 14:
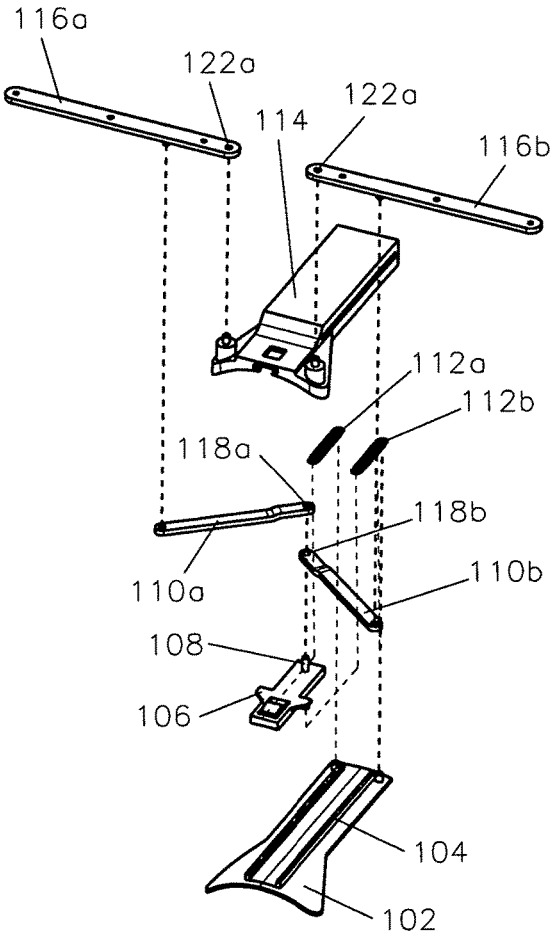
FIG. 14 is an exploded view of the scissor mechanism of the hand paddle of FIG. 10.
Figure 15:
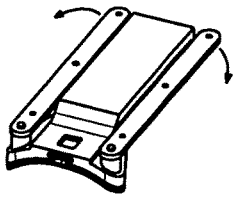
FIG. 15 is a perspective view of the scissor mechanism of the hand paddle of FIG. 10 in its closed position.
Figure 16:
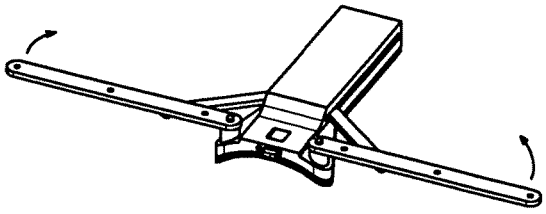
FIG. 16 is a perspective view of the scissor mechanism of the hand paddle of FIG. 10 in its open position.
Figure 17:
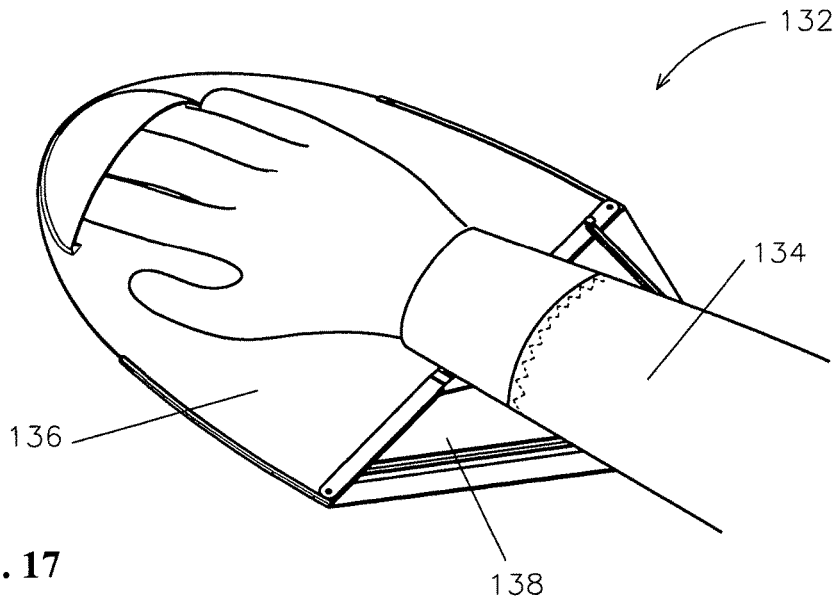
FIG. 17 is a perspective view of a person's hand inserted into a fourth preferred embodiment of a hand cover apparatus, in the form of a hand paddle, according to the present invention.
Figure 18:
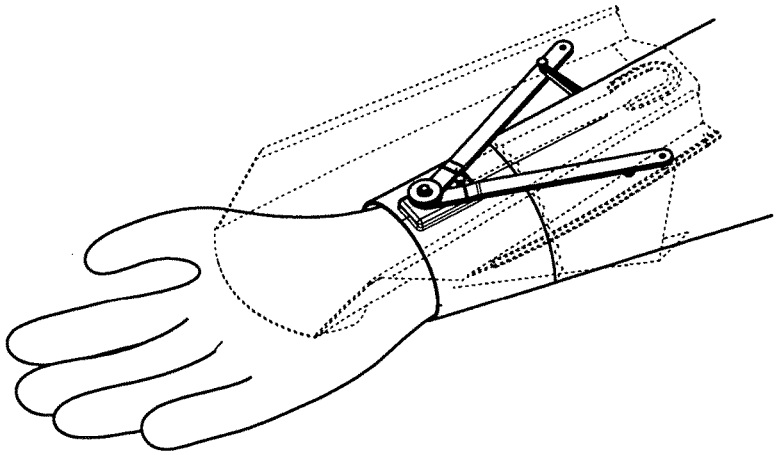
FIG. 18 is a perspective view of the hand paddle of FIG. 17 with its blade collapsed, shown in hidden line form to reveal aspects of the embodiment.
Figure 19:
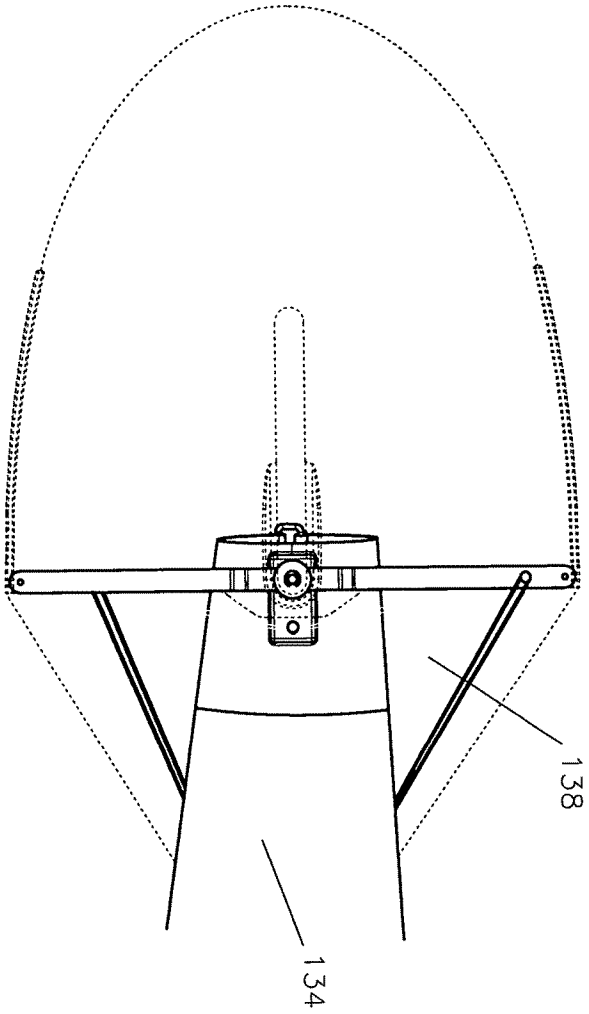
FIG. 19 is a top plan view of the hand paddle of FIG. 17 with its blade in its open position.
Figure 20:
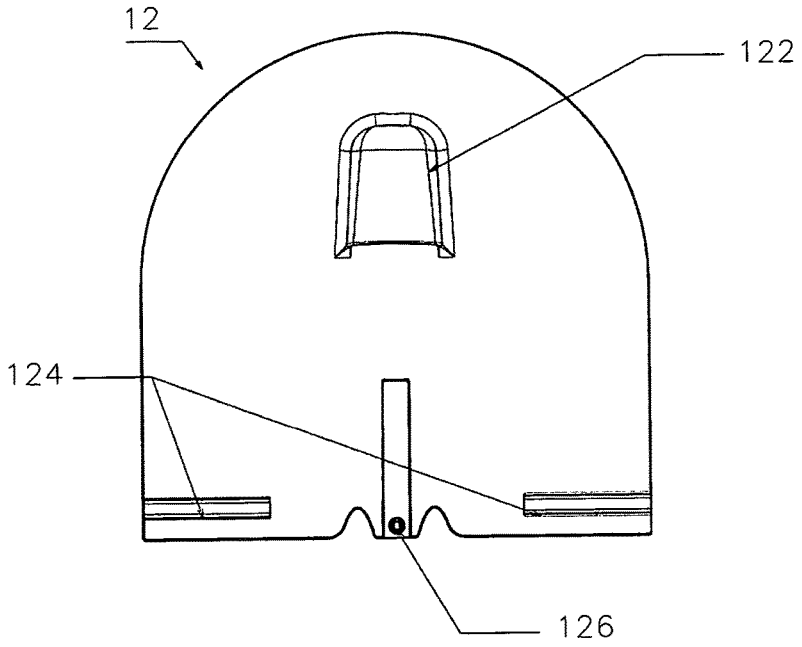
FIG. 20 is a perspective view of a person's hand inserted into another preferred embodiment of a hand cover apparatus, in the form of a hand paddle, according to the present invention.
Figure 21:
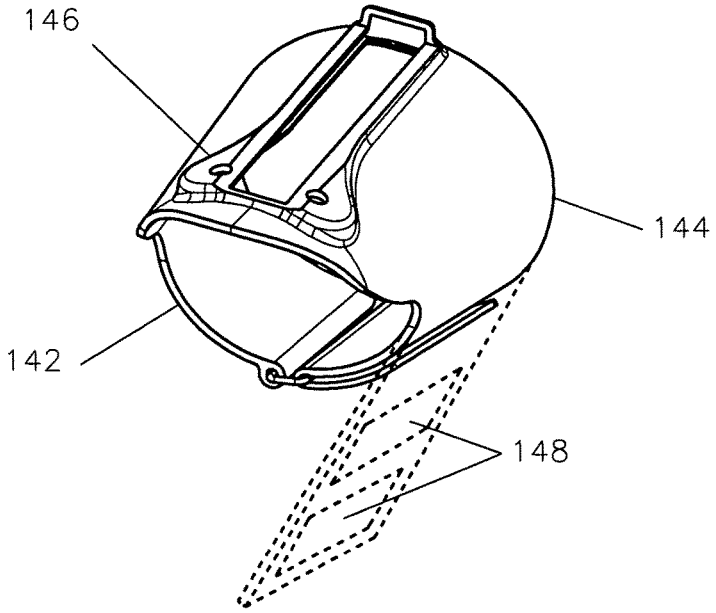
FIG. 21 is a perspective view of the sleeve of the hand paddle of FIG. 20.
Figure 22:
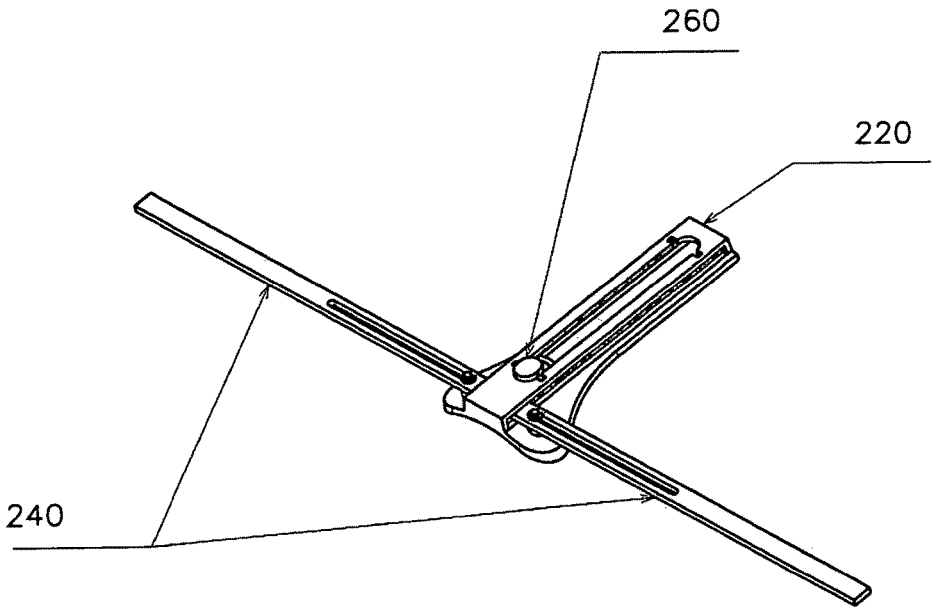
FIG. 22 shows the tension mechanism of FIG. 20 in an opened position.
Figure 23:
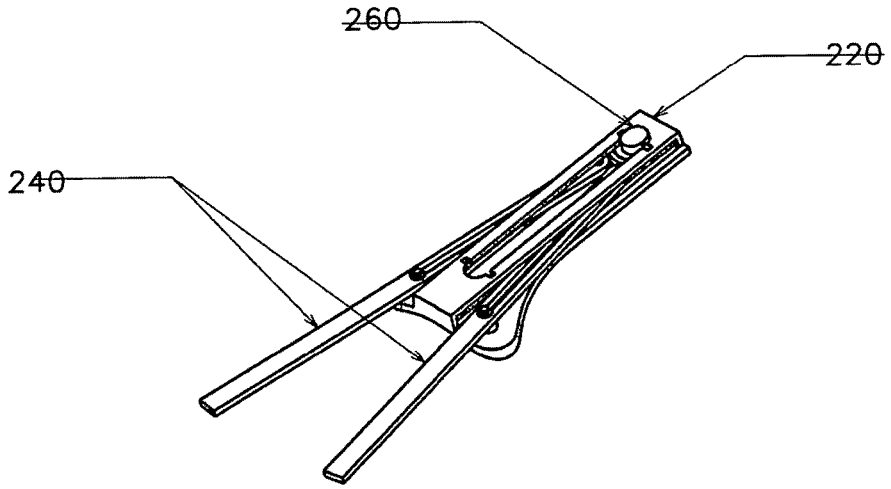
FIG. 23 shows the tension mechanism of FIG. 20 in a closed position.

FIGS. 10-16 show a third preferred embodiment of a hand paddle 86 according to the present invention with a person's hand inserted in it in FIGS. 10-12. Hand paddle 86 generally comprises paddle blade 88; tensioning mechanism 90; and sleeve 92. The materials and alternative structures mentioned in the description of the first preferred embodiment generally equally apply here where the same or similar parts or features are used or employed.

Major features of paddle blade 88 include finger pocket 94 (FIG. 12), used as a harness to operate hand paddle 86; slot 96 (best shown in FIG. 13) that interacts with tensioning mechanism 90; a pair of cord apertures 98 and a number of folding points or ribs 100.

Major features of tensioning mechanism 90 include (FIG. 14) tensioner base 102 with track 104; track follower 106 with pivot post 108; arm pullers 110*a* and 110*b*; tensioning members 112*a* and 112*b*, shown in the form of coil springs; tensioner cover 114; and tensioner arms 116*a* and 116*b*. One end of each coil spring 112*a* and 112*b* are connected to tensioner base 102 and the other ends are connected to track follower 106, such that tensioning members 112*a* and 112*b* urge track follower 106 toward the back of tensioner base 102. Ends 118 a and 118*b* of arm pullers 110 a and 110*b* are pivotally connected to pivot post 108, creating center fulcrum 120. Ends 122 a and 122*b* of tensioner arms 116*a* and 116*b* are pivotally connected to tensioner cover 114 and arm pullers 110*a* and 110*b* such that they are urged from an extended position (FIG. 16) to a retracted position against tensioner cover 114 (FIG. 15), effectively collapsing blade 88 into a closed position (FIG. 11).

Major features of sleeve 92 include band 124; cinching ring 126; and band flap 128 with closure (not shown).

When used, a person places a hand through sleeve 92 such that cuff 130 of sleeve 92 is positioned adjacent the wrist area (FIGS. 10 and 11), and cinches it to the arm so that sleeve 92 does not rotate on the arm during use of hand paddle 86. One or more fingers may be placed in finger pocket 94 and extended, such that the collapsible paddle blade 88 is moved from a closed position to an open position.

FIGS. 17-20 show a fourth preferred embodiment of an arm-mounted hand paddle 132 according to the present invention, incorporated into the arm of a wetsuit 134. Many of the parts of this embodiment are similar to the first embodiment shown in FIGS. 1-5, except that its integration into wetsuit sleeve 132 enables paddle blade 136 to be larger, with extended section 138 extending back further on the user's arm. Alternatively, this larger embodiment could also be used as a standalone version, using a sleeve or an elongated attachment mechanism similar to that used in FIGS. 1-5. The tension levers 36A and 36B may connect to tensioner posts 28, located on the side of a wetsuit sleeve or apparatus sleeve 16.

Referring to FIGS. 1-5, a second pair of slave tension arms or levers, similar to levers 36A and 36B in dimensions and material and mounted in the same way on the apparatus.

These levers would pivot exactly like levers 36A and 36B and be connected to levers 36A and 36B at their outermost ends by an inflexible medium such as a bracket with pivoting rivets at its end where it connects the front and back levers. Thus, when a front lever moves the back lever would have to move with it. In this case, tensioning member 38, in the form of an elastic band, could be connected only to the rear slave levers to pull the paddle closed. The front tension levers would not need them. A non-water permeable surface, such as neoprene or the material used on the rest of the paddle, could connect to the sleeve behind the rear slave levers to extend the paddle's surface area even more. (parts of the embodiment not shown)

Figure 24:
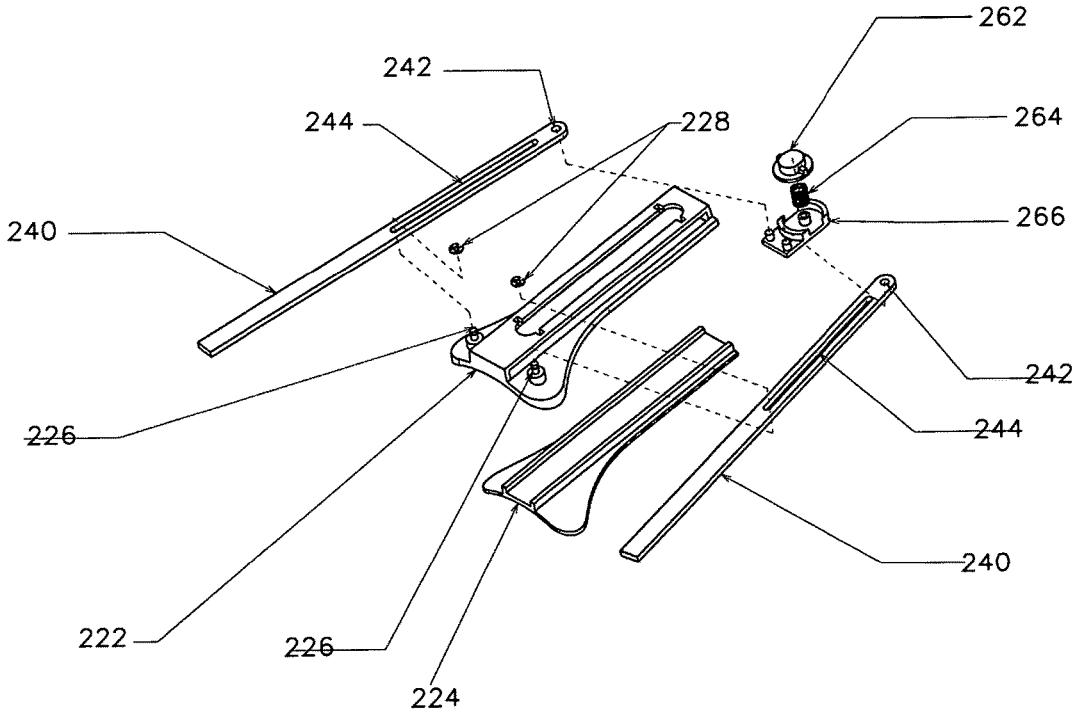
FIG. 24 Shows an exploded view of an alternative tension mechanism according to the present invention.
Figure 25:
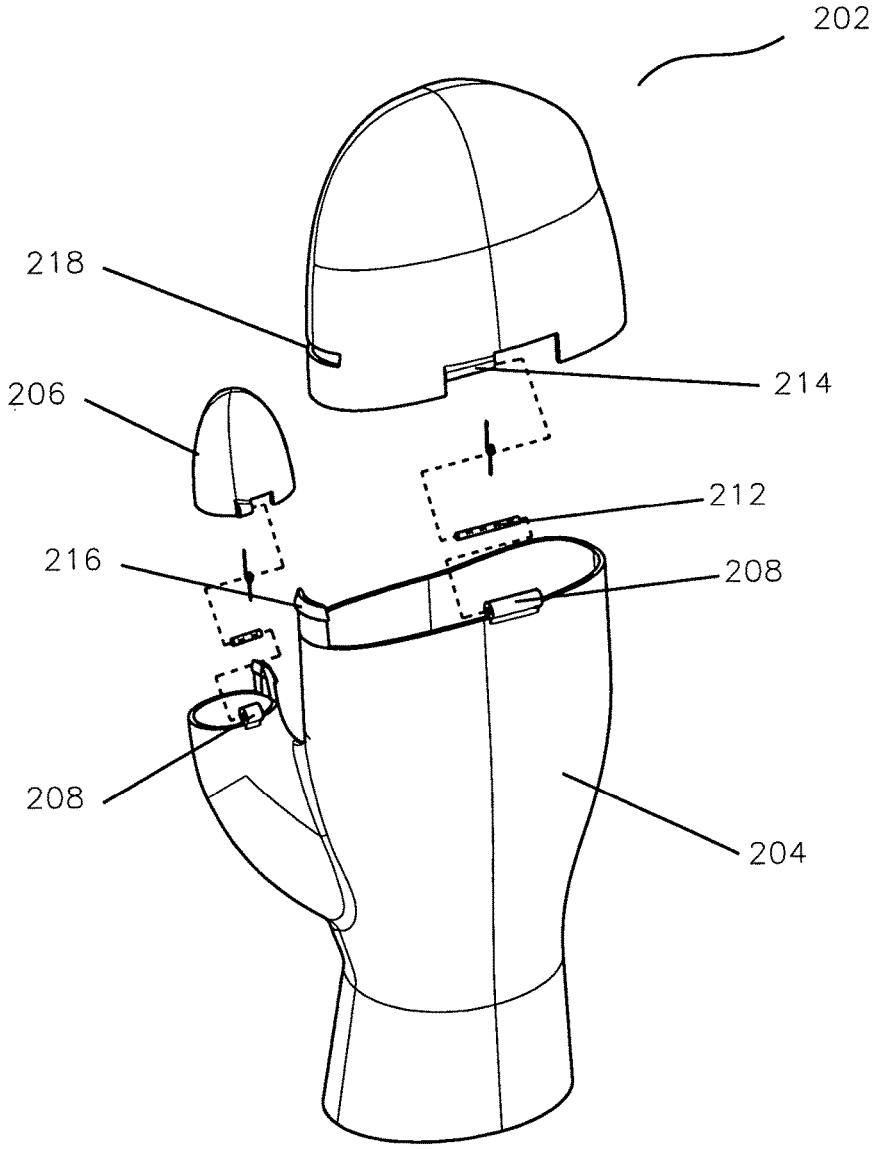
FIG. 25 shows an exploded view of a glove or mitten embodiment of the hand cover apparatus.
Figure 26:
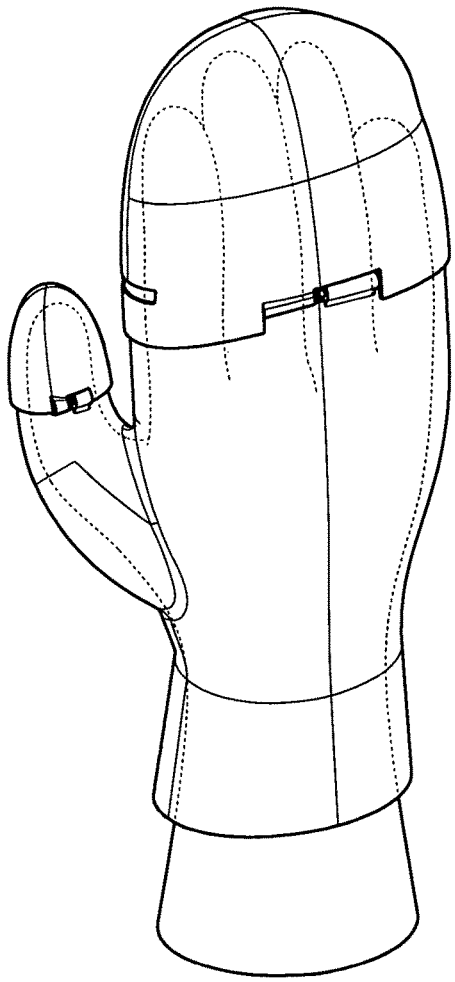
FIG. 26 shows a closed view of the hand cover of FIG. 25.

FIGS. 24, 25, and 26 show another preferred embodiment of a tensioning mechanism 21 which may be used in practicing the invention. Its major features include tensioner plate 266 with spring 264 and resistance catch 262, and tensioner post 242. The plate slides back and forth inside track 244 which is secured to sleeve 48 (not shown) and cover 222 which has tension lever guide posts 226 on each of its sides such that it runs through slot 244 on tension levers 240 which are connected to tensioner plate 266 by at post 242. Retaining clips 228 secure the top of the posts.

In operation, tensioner plate 266 is forced forward by its connection to finger pocket 18 and blade 12, which connects to the ends of the tension levers by a means similar to that described in the first preferred embodiment. In this tensioning mechanism 21, the tension levers 240 connect to plate 266 in the back of the apparatus and is pulled forward to open the unit. The levers are guided out and to the sides.

On the front and back ends of cover 222 are small groves cut into each side of the track. They are V shaped and to fit the correspondingly V shaped extensions on spring loaded button 262. This is to provide a resistance catch to help keep the paddle open when opened and closed when closed unless the excerpts a set amount of force pushing back or pulling forward the finger pocket. A small catch may be added at the base of the finger pocket so that the fingers can catch it and push the paddle back with sufficient force to push the V on button 262 out of the V shaped slot on cover 222. This is to help the paddle stay open if desired to prevent fatigue caused by the user's hand always having to keep pressure on the glove to prevent the tension from closing it. Many catch systems are available and could be used here. In addition to this the tension band if connected to the two extension levers, would counter act itself when the levers are at a 180 degree angle from each other making it easy to keep the glove open. Once the tension levers are pushed to about a 170 degree angle from each other the tension band connecting them would act with greater force to pull them back and close the glove.

While these are illustrated preferred embodiments of the paddle it should be noted that the tension system is an added benefit which automatically closes the paddle. The paddle could operate without it and be manually pushed close by the user's hand. The apparatus could also be designed to use only a front sliding pull open cover, without the expanding sides. Or expanding sides without the front portion covering the hand provided there was a harness or other connection means to the fingers to pry open the paddle. They could both work independently of each other if desired. If the paddle blade itself is made of a sufficiently stretchy material it could provide enough tension to pull itself closed without any additional springs or tension bands.

A cover made of material with elastic properties such as latex could be used to add both tension and padding to the unit. The springs or tension bands used in the system could then be supplemented or eliminated.

If the blades, or the perimeters of the paddle which connect to the expansion arms are made of non stretching or minimally stretchable material, then Prying forward the finger pocket secured to the blades or the inflexible perimeter would in turn force the expansion arms to open that's opening the glove. For example, if an inflexible cable could be run through a pocket from the end of one tension lever, around the finger pocket, and to where it connects to the tension lever on the other side of the paddle. When the finger pocket was pushed forward the tension levers would be pushed forward with them to open the paddle. If secondary slave tension levers were used the above method would open them too via their connections to the primary tension levers as previously described. The finger pocket in all embodiments are designed and positioned so that the user's fingers can easily and readily slip into or out of it to operate the hand cover.

Also, while the preferred embodiments shown have all used scissoring or pivoting tension levers to expand the paddle, firm side panels could be used with a raised lip, slot and groove system (slots on either the forearm mounted base and raised lips on the sliding side panels. The raised lips would be angled forward and outward from the rear center of the unit so that when the finger panel is pried forward, it forces the connecting side panels forward and they are guided out to the sides of the paddle by the correspondingly angled slots and grooved lips in much the same way that the pivoting tension arms are forced out and to the sides when the finger pocket is pried forward. The raised lips may have a bracket attached to the top of them to prevent the sliding side panels from slipping of the top of them. (Not shown)

Figure 27:
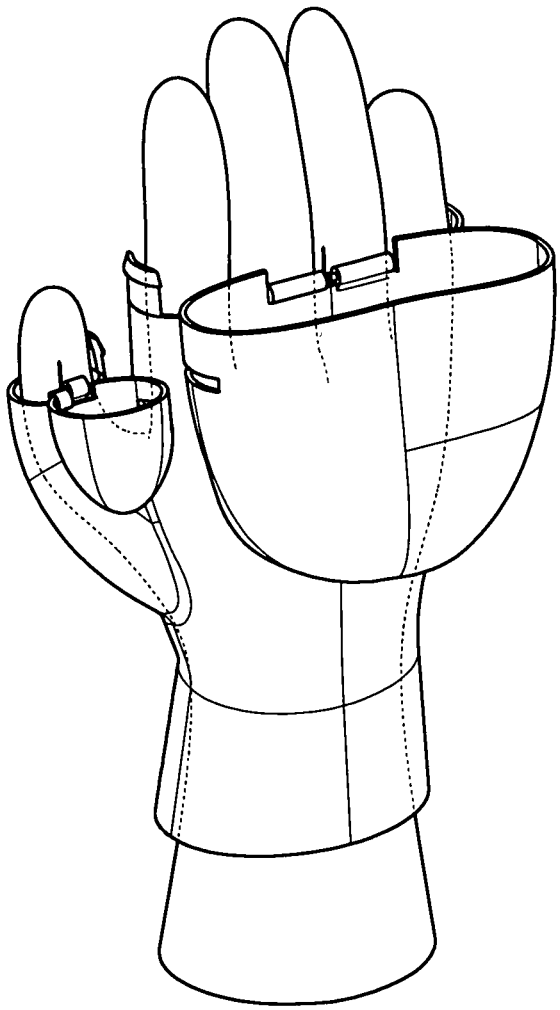
FIG. 27 shows an open view of the hand cover of FIG. 25.

FIGS. 25, 26, and 27 show a preferred embodiment of the hand cover as used in a glove or mitten. The glove itself is made from the same materials that are common for gloves today. Glove main body 204 is connected on its top side to glove top 202 and thumb top 206 by hinge pins 212 which runs through corresponding pockets 208 on both the on their top sides. Hinge pins 212 runs through torsion spring 210 which connects to both the top (202 and 206) piece and the bottom glove body 204 for the purpose of providing tension to the system. When the glove is closed over the user's hand as shown in FIG. 26, it is under tension provided by spring 210 which is trying to pull glove and thumb top 202 and 206 back over the top side of glove body 204 where tension from spring 210 would hold the glove open as seen in FIG. 27. This would free a user's fingers to perform tasks unhindered.

Once opened the glove can be pushed closed by folding tops 202 and 206 over until they contact the bottom side of the glove where they contact the bottom side of the glove to close as seen in FIG. 26. To keep the glove closed two trigger extensions 216 with a protrusion at their outward facing end raise from the bottom of glove base and latch through a similarly shaped slit cut into the top portion of the thumb and fingers 206 and 204 in such a way that trigger extension 216 fits through the slit and they snap shut. The lip on the thumb side of trigger extension 216 and the lip on the main finger compartment of base 204 are positioned in such a way that they face each other and can be pressed against each other. To open the glove the lips on triggers 216 are pushed together by the thumb and trigger finger from inside the glove. Thus both lips 216 are pushed free and of their corresponding slits causing both the thumb and finger tips to be pulled back over the top of the glove by the tension provided by spring 210 forcing it to instantly open and free the fingers.

Many such options are available to lock the top and bottom of the glove including a magnet lock which could be pushed out by the thumb and fingers inside the glove to release the top parts of the glove and open the system as well as numerous other button style lock releases. If desired the lock could be placed only on the thumb and trigger finger of a separately fingered glove. Also in a mitten-style hand cover room could be left in the thumb section so that the thumb could be slid out into the main finger area of the glove to activate a release mechanism which could open the very front of the main finger area of the mitten and then pull the top and bottom portions of the glove back onto the forearm and out of the way via a tension mechanism and track leading up onto the forearm in much the same way as paddle version in FIGS. 1 through 5. (Not shown)

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

I claim:

1. A hand cover apparatus, comprising:
a stationary hand cover portion;
a plurality of locking mechanisms;
a plurality of hinge mechanisms;
a plurality of retracting hand cover portions; and
a plurality of tensioning mechanisms;
wherein said stationary hand cover portion is configured to cover a back side and a palm side of a user's hand;
wherein said plurality of locking mechanisms are attached to a distal end of said stationary hand cover portion;
wherein said plurality of hinge mechanisms are attached to a distal end of said stationary hand cover portion;
wherein said plurality of retracting hand cover portions are attached by said plurality of hinge mechanisms to said stationary hand cover portion;
wherein said plurality of tensioning mechanisms are attached to said stationary hand cover portion and said plurality of retracting hand cover portions;
wherein said plurality of locking mechanisms removably engage said plurality of retracting hand cover portions in a closed position; and
wherein said plurality of tensioning mechanisms retract said plurality of retracting hand cover portions to an open position.

2. The invention of claim 1,
wherein said plurality of locking mechanisms comprise a thumb locking mechanism and an index finger locking mechanism;
wherein said plurality of retracting hand cover portions comprise a thumb cover portion and a finger covering portion;
wherein said thumb locking mechanism is located on a medial side of a thumb opening in said distal end of said stationary hand cover portion;
wherein said index finger locking mechanism is located on a medial side of a finger opening in said distal end of said stationary hand cover portion;
wherein said thumb locking mechanism locks said thumb cover portion in a closed position; and
wherein said index finger locking mechanism locks said finger covering portion in a closed position.

3. The invention of claim 2, further comprising;
a use-specific modification;
wherein said use-specific modification is selected from the group consisting of a cold-weather glove, a cold weather mitten, a tactical glove, a photography glove, and a capacitive glove.

4. A hand cover apparatus, comprising:
a forearm mount;
a retracting hand cover portion; and
a finger pocket;
wherein said forearm mount is attached to said retracting hand cover portion;
wherein said forearm mount further comprises a fastening means;
wherein said fastening means attaches said forearm mount around a portion of a user's arm below an elbow;
wherein said finger pocket is attached to said retracting hand cover portion;
wherein said finger pocket is configured to engage at least one finger of said user's hand; and
wherein engaging said finger of said user's hand to said finger pocket facilitates movement of said retracting hand cover portion to cover a portion of said user's hand.

5. The invention of claim 4,
wherein said hand cover apparatus is configured for use as a paddle for propelling a user through water.

6. The invention of claim 5,
wherein a wetsuit sleeve is used as said forearm mount to secure said hand cover apparatus to said user's arm thereby eliminating the need for an extra strap when said wetsuit is used in combination with said apparatus.

7. The invention of claim 4,
wherein at least one tensioning mechanism retracts said retracting hand cover portion to uncover some portion of said user's hand.

8. The invention of claim 4, further comprising:
a means of expansion;
wherein said means of expansion reversibly expands said retracting hand cover portion to increase a surface area of said retracting hand cover portion.

9. The invention of claim 4, further comprising:
a tension mechanism;
a slide mechanism; and
a plurality of expansion arms;
wherein said slide mechanism has a forward position and a rear position;
wherein moving said slide mechanism to said forward position causes said plurality of expansion arms to extend away from said hand cover apparatus; and
wherein moving said slide mechanism to said rear position causes said plurality of expansion arms to retract toward said hand cover apparatus.

10. The invention of claim 4, further comprising:
a fold in said retracting hand cover portion;
wherein said fold allows said retracting hand cover portion to fold in on itself when retracted; and
wherein said fold allows said retracting hand cover portion to stretch to a maximum surface area when extended.

11. The invention of claim 10, further comprising:
a capping means;
wherein said capping means prevents said retracting hand cover portion separating from said forearm mount.

12. The invention of claim 4, further comprising:
a rigid, semi-flexible rim;
wherein said rim is embedded around at least some portion of a perimeter of said retracting hand cover portion.

13. The invention of claim 4, further comprising:

At least one releasable catch mechanism;

wherein said catch mechanism locks said retracting hand cover portion into a locked position when said catch mechanism is engaged; and wherein said catch mechanism is released to allow said retracting hand cover portion to move.

14. The invention of claim 4,

Wherein said retracting hand cover portion is at least partially composed of a stretchable water impermeable material.

15. The invention of claim 4, wherein said retracting hand cover portion comprises a heat-resistant material of construction.

16. A hand cover apparatus, comprising:

a forearm mount;

a retracting hand cover portion;

at least one finger pocket; and a plurality of expansion arms;

wherein said forearm mount is attached to said retracting hand cover portion;

wherein said forearm mount further comprises a fastening means;

wherein said fastening means reasonably attaches said forearm mount around a portion of a user's arm below an elbow;

wherein said finger pocket is attached to said retracting hand cover portion;

wherein said finger pocket is configured to engage at least one finger of said user's hand; and wherein engaging said finger of said user's hand to said finger pocket facilitates the movement of said expansion arms to expand outward from said hand cover apparatus.

17. The invention of claim 16, wherein said hand cover apparatus is configured for use as a paddle for propelling a user through water.

18. The invention of claim 17, wherein a wetsuit sleeve is used as said forearm mount to secure said hand cover apparatus to said user's arm thereby eliminating the need for an extra strap when said wetsuit is used in combination with said apparatus.

19. The invention of claim 16, further comprising:

a means of expansion;

wherein said means of expansion reversibly expands said retracting hand cover portion to increase a surface area of said retracting hand cover portion.

20. The invention of claim 16, wherein a tensioning mechanism retracts said retracting hand cover portion to uncover at least some portion of a user's hand.

* * * * *